US007337857B2

(12) United States Patent
Vonhof et al.

(10) Patent No.: US 7,337,857 B2
(45) Date of Patent: Mar. 4, 2008

(54) EXTINGUISHING OR WATERING SYSTEM AND ADMIXING SYSTEM THEREFOR INCLUDING METHOD ASSOCIATED THEREWITH

(75) Inventors: Alexander Vonhof, Wuppertal (DE); Stefan Rassek, Wuppertal (DE); Matthias Dietrich, Radevormwald (DE); Andreas Waetzoldt, Wuppertal (DE)

(73) Assignee: Bernd-Dietrich Rassek, Wuppertal (DE)

( * ) Notice: Subject to any disclaimer, the term of this patent is extended or adjusted under 35 U.S.C. 154(b) by 252 days.

(21) Appl. No.: 10/835,258

(22) Filed: Apr. 28, 2004

(65) Prior Publication Data

US 2005/0023006 A1 Feb. 3, 2005

(30) Foreign Application Priority Data

Apr. 30, 2003 (DE) ..... 103 19 726

(51) Int. Cl.
*A62C 2/00* (2006.01)

(52) U.S. Cl. ..... 169/44; 169/14; 169/16; 169/46; 239/10; 239/207; 239/209; 239/303; 239/305; 239/310; 239/124

(58) Field of Classification Search ..... 169/44, 169/13, 16, 27, 78, 14, 46; 239/398, 418, 239/569, 207–209, 303–305, 310, 318, 124, 239/10; 222/145.5, 135
See application file for complete search history.

(56) References Cited

U.S. PATENT DOCUMENTS 346,571 A 8/1886 Ashcroft
1,299,272 A 4/1919 Walker
1,403,596 A 1/1922 Erwin et al.
1,467,377 A 9/1923 Hamilton
3,762,477 A * 10/1973 Mobley, Sr. ..... 169/61

(Continued)

FOREIGN PATENT DOCUMENTS

DE 3726672 4/1988

(Continued)

*Primary Examiner*—Steven J. Ganey
(74) *Attorney, Agent, or Firm*—Friedrich Kueffner

(57) ABSTRACT

In order to refine an admixing system (100) for admixing at least one extinguishing agent additive (32) to at least one extinguishing agent (22), having at least one extinguishing agent additive pump (34*p*1, 34*p*2, 34*p*3), particularly implemented as a component of or in the form of at least one dosing unit or at least one admixer (34), which mixes the extinguishing agent additive (32) into at least two extinguishing agent lines (26) using overpressure and which is connected to at least two watering or sprinkler units (10), in such a way that directly after the admixing system (100) is put into operation, without greater outlay, all watering or sprinkler units (10) have a mixture made of extinguishing agent (22) and extinguishing agent additive (32) available, it is suggested, that the extinguishing agent additive pump (34*p*1, 34*p*2, 34*p*3) be connected to each of the watering or sprinkler units (10) via at least one extinguishing agent additive line (36) in each case and that the particular extinguishing agent line (26*a*, 26*b*, 26*c*, 26*d*, 26*e*, 26*f*) be brought together and/or unified with the particular extinguishing agent additive line (36*a*, 36*b*, 36*c*, 36*d*, 36*e*, 36*f*) in the region of, particularly shortly before in regard to the flow direction (R), the particular watering or sprinkler unit (10).

15 Claims, 4 Drawing Sheets

U.S. PATENT DOCUMENTS

2004/0020664 A1* 2/2004 Juidici et al. ..... 169/44

FOREIGN PATENT DOCUMENTS

DE 100 13 974 A1 10/2001
EP 0 638 333 2/1995
EP 638333 A1 * 2/1995
EP 1029560 8/2000
EP 1 147 788 10/2001

* cited by examiner

EXTINGUISHING OR WATERING SYSTEM AND ADMIXING SYSTEM THEREFOR INCLUDING METHOD ASSOCIATED THEREWITH

TECHNICAL FIELD

The present invention relates to an admixing system for admixing at least one extinguishing agent additive to at least one extinguishing agent, having at least one extinguishing agent additive pump, particularly implemented as a component of or in the form of at least one dosing unit or at least one admixer,

- which mixes the extinguishing agent additive into at least two extinguishing agent lines using overpressure and
- which is connected to at least two watering or sprinkler units.

The present invention further relates to an extinguishing or watering system, having

- at least one admixing system according to the above-described type,
- at least one extinguishing agent container for storing the extinguishing agent,
- at least one extinguishing agent pump, which is connected to each of the watering or sprinkler units via at least one extinguishing agent line in each case, and
- at least one extinguishing agent additive container for storing the extinguishing agent additive.

The present invention further relates to a method for operating an admixing system of the above-described type and/or an extinguishing or watering system of the above-described type.

RELATED ART

Using fire extinguishing agents based on water in fixed extinguishing systems is known. In this case, a fixed extinguishing system is understood as a continuously available system in which extinguishing agents are delivered from a fixed pipeline system via suitable delivery devices. Fixed extinguishing systems may be activated automatically or by hand (cf. also DIN 14011-5:1980-05: "Begriffe aus dem Feuerwehrwesen—Brandschutzeinrichtungen [Terms from Firefighting—Fire Protection Devices]").

The fixed extinguishing systems which operate using aqueous extinguishing agents particularly include:

- sprinkler systems (DIN 14489:1985-05),
- water spray extinguishing systems (DIN 14494:1979-03), and
- foam extinguishing systems (DIN norm series 14493).

If water is used as the extinguishing agent without special additives, one also refers to water extinguishing systems.

Fixed extinguishing systems are basically constructed in such a way that a pipeline network, in which the liquid medium reaches the source of fire, at which the liquid medium unfolds its extinguishing effect, is led outward from a central point, such as the sprinkler control center. Typically, water is used as the extinguishing agent.

For special fire materials and/or fire dangers an accessory agent which improves the extinguishing property may or must be added to the water; thus, for example, in foam extinguishing systems the addition of foaming agent as an accessory agent is the feature which distinguishes the system.

Extinguishing systems may be divided into two groups in principle: wet extinguishing systems and dry extinguishing systems. In wet extinguishing systems, the extinguishing agent is in the pipelines even before the fire extinguishing system is activated; the medium is thus immediately at the fire location upon activation of the extinguishing system. In contrast, in dry extinguishing systems, the pipeline network is only filled upon activation and/or operation of the fire extinguishing system.

Typically, in wet or dry extinguishing systems the accessory agent is added to the extinguishing agent at a central point (referred to in the following as "case A") or in wet extinguishing systems the extinguishing agent is admixed "beforehand" (referred to in the following as "case B"; cf. also VdS CEA 4000 1:2003-01 "Sprinkleranlagen—Planung und Einbau [Sprinkler Systems—Planning and Installation]", Appendix M). In the latter case, an extinguishing water-accessory agent mixture (premix) is applied directly at the activation point, because of which one also refers to a premix system.

The particular problems of the two methods described have the following causes:

Case A—Central Admixing:

The accessory agent is already added in the extinguishing control center. Particularly in wet extinguishing systems, the extinguishing agent-accessory agent mixture, which is premixed there, requires a significant pathway and therefore a significant period of time before it reaches the fire location. Up to this time, which may be necessary for successful firefighting, the increased extinguishing effect intended for the extinguishing system is not achieved in regard to the extinguishing agent delivered previously.

Case B—Premix System:

In the case of the premix system, the extinguishing agent-accessory agent mixture is already available directly at the fire location. Therefore, the intended extinguishing effect is achieved from the beginning of firefighting on. The disadvantage of this method is, however, that the accessory agent—always a mixture having different surfactants—has been shown to be highly corrosive to the materials of the pipeline network. Therefore, the pipeline network must be refurbished frequently, at a high cost. Specific materials which are cheaper to use may also not be used at all, so that higher installation costs may arise and retrofitting of existing systems is sometimes not possible or advisable at all.

Fire extinguishing agents permitted in Germany are also always designed as biologically compatible in accordance with the land regulations on fire extinguishing devices and fire extinguishing agents. In premix solutions, the accessory agent is therefore biologically decomposed bit by bit, so that the extinguishing effect dissipates over time. In addition, some extinguishing agent additives, such as class A foam (=special foaming agent for firefighting of solid fuels) are not suitable to be used as a premix.

A further aspect relates to environmental protection. If the effectiveness of the extinguishing agent additive falls below a specific value, the entire pipeline network is to be filled with new premix. In this case, the old premix is to be disposed of an environmentally correct way, the accessory agent typically representing a water-contaminating material and the disposal cost being correspondingly high.

Typically, in stationary or semi-stationary extinguishing technology for aqueous extinguishing agents, the addition of accessory agents, such as foaming agents, is therefore performed either directly in the extinguishing control center or by providing a premixed solution, a premix, in the extinguishing system. These two variations have the disadvantage that either the extinguishing agent mixture is available very late at the fire location or problems arise with the pipelines or with the premix, through decomposition or usage restrictions, for example.

In the most recent considerations and plans of manufacturers of system components, the possibility of decentralized admixture of extinguishing agent additives has already been thoroughly speculated on (cf. brochure of MSR Dosiertechnik GmbH, Wölfersheim, 2002: "Betriebsanleitung FireDos® Zumischsystem für Brandbekämpfungsflüssigkeiten [Operating Instructions for FireDos® Admixing System for Firefighting Liquids]", p. 19).

The principle described therein is, however, not suitable for a building having multiple sprinkler groups. However, multiple sprinkler groups are typically present in single buildings or building parts, such as two groups for ceiling sprinklers and one group for shelf sprinklers. In this case it is possible, of course, that only one or even multiple sprinkler groups activate simultaneously.

The system presented in this brochure is only suitable for the purpose of supplying one single sprinkler group or even the entire sprinkler system, for example, with extinguishing agent additives using central admixing in the sprinkler control center. Therefore, it represents a combination of case "A" presented with case "B" presented; this combination is not suitable for the purpose of supplying a building having multiple sprinkler groups quickly with extinguishing agent additives. The principle described also corresponds to a combination of a fixed extinguishing system with a partially mobile (<->manual intervention necessary) extinguishing system.

Also to be noted in the technical area discussed is the publication U.S. Pat. No. 1,467,377, in which a method for admixing (dosing) liquid extinguishing agent additives is disclosed, the extinguishing agent additives being admixed directly at the sprinkler or at the outlet nozzles for firefighting agents. With a construction of this type, the system requires nearly as many extinguishing agent additive containers and extinguishing agent additive pumps (admixers) as sprinkler heads.

A partially mobile fire extinguishing device in which two liquid extinguishing agents may be mixed at the outlet nozzle of a firefighting hose is described in the publication U.S. Pat. No. 1,299,272. This method is designed for manual operation of a firefighting hose or an extinguishing water line and may not be transferred to an extinguishing system having multiple watering or sprinkler units.

Furthermore, a mobile pump unit for firefighting, which may provide both wet and dry foam or even water as the extinguishing agent either individually or simultaneously, is known from the publication EP 1 029 560 A2. This pump unit is also designed for only one extinguishing water line.

In the publication DE 100 13 974 A1, a pressure admixer suitable for both centralized and decentralized foam supply is suggested, which is essentially intended for use in mobile firefighting; in principle, this known pressure admixer could also be used in fixed extinguishing systems.

In the system according to the publication DE 100 13 974 A1, the foam line or extinguishing agent additive line discharges into the nozzle housing of the watering or sprinkler unit, which appears problematic considering the corrosive effect of the extinguishing agent additive (however, the corrosiveness is not always relevant in case of sprinkler activation in a fire).

A further disadvantage of the pressure admixer described in the publication DE 100 13 974 A1 is that a complex pipeline system having primary and secondary flow lines of the extinguishing agent is necessary in order to be able to regulate the admixing of the extinguishing agent additive uniformly.

Finally, in this known system, in which a check valve may be positioned before the admixing unit, a Venturi nozzle is used in the extinguishing agent supply. Venturi or similar known admixing systems are disadvantageously strongly dependent both on initial and flow-through pressures and on counter pressures in the intake and delivery side water and accessory agent lines.

The known Venturi principle exists in different technical embodiments, for example, as a suction admixer, as a balanced pressure admixer, or as a blow tank admixer (overpressure on the intake side of the accessory agent, used in sprinkler systems, among other things). However, all of these systems function on the basis of the injector principle.

The length of the intake path of the Venturi admixer is limited, and the intake quantity is pressure-dependent. In order to stabilize the system for sprinkler systems, the accessory agent is therefore placed under pressure (blow tank) in order to make the intake easier and to fix the admixing rate.

Finally, an extinguishing system of the type initially cited is known from the publication DE 37 26 672 A1. In this device for fire extinguishing vehicles, which is equipped with an automatic, electronically controlled admixer, a foaming agent is mixed with the extinguishing water behind the extinguishing water pump, after which the extinguishing water-foaming agent mixture is supplied to multiple consumers via branch lines.

The variation according to the publication DE 37 26 672 A1 is not suitable for a fire extinguishing system having multiple watering or sprinkler units, because in this case the extinguishing agent mixture only reaches the watering or sprinkler units which are not placed near the extinguishing water pump after a delay.

DESCRIPTION OF THE PRESENT INVENTION: OBJECT, ACHIEVEMENT OF THE OBJECT, ADVANTAGES

On the basis of the disadvantages and shortcomings described above and taking the related art outlined into consideration, it is to be ensured through the present invention that directly after the admixing system is put into operation, without a greater outlay, all watering or sprinkler units have a mixture made of extinguishing agent and extinguishing agent additive available.

This object is achieved by an admixing system having the features specified in claim 1 and by an extinguishing or watering system having the features specified in claim 6 and by a method having the features specified in claim 9. Advantageous embodiments and expedient refinements of the present invention are specified in the particular subclaims.

According to the present invention, the extinguishing agent additive is first added to the extinguishing agent in the moment the admixing system and/or the extinguishing or watering system having the admixing system according to the present invention is put into operation, the extinguishing agent additive pump being connected to each of the watering or sprinkler units via at least one extinguishing agent additive line.

Suitable and resistant lines are advantageously used for the extinguishing agent additive or the accessory agent, so that the disadvantages of the corrosiveness and decomposition of the extinguishing agent additive in the pipelines are dispensed with.

According to the present invention, the particular extinguishing agent line is brought together or unified with the particular extinguishing agent additive line or accessory agent line in the region before, particularly shortly before, the particular watering or sprinkler unit. In this way, the extinguishing agent additive or the accessory agent, i.e., the additive, is first added to the pipeline network of the extinguishing agent, i.e., supplied to the sprinkler group, as close as possible to the fire location. The additive or accessory agent is especially fed under pressure into the extinguishing water line as close as possible to the individual sprinkler groups.

This offers the advantage that environmentally harmful premix solutions may be avoided and in principle all liquid extinguishing agent additives may be used, i.e., even class A foam, which is not even usable as a premix solution in the related art.

In an advantageous embodiment of the present invention, the extinguishing agent additive line is already filled with the accessory agent, this accessory agent only being added to the extinguishing agent when the admixing system and/or the extinguishing or watering system is activated.

Through admixing and/or dosing of this type, which is decentralized in a way essential according to the present invention, the complete extinguishing effect is implemented quickly when the admixing system and/or the extinguishing or watering facility is put into operation. In addition, the present invention is distinguished by its simple construction, its practical capability in firefighting, and its good ability to be retrofitted in existing extinguishing or watering systems.

In a preferred embodiment of the admixing system, the extinguishing agent additive or admixing pump is based on a hydraulic drive. The extinguishing agent volume flows through this drive. The mechanism inside the drive exploits existing pressure differentials and converts these pressure differentials into reciprocating or rotational movements.

Furthermore, in an expedient embodiment of the admixing system, the extinguishing agent additive pump is connected to the drive via at least one mechanical coupling for torque transmission and conveys the accessory agent out of the extinguishing agent additive container or supply container into the accessory agent lines and from there directly into the extinguishing water volume of the watering or sprinkler units, such as the sprinkler groups.

The accessory agent or extinguishing agent additive pump is advantageously implemented as at least one piston pump, because a pump of this type may overcome the pressure losses of the intake and admixing lines and produce the pressure increase necessary for admixing.

Besides the main components described: drive, additive pump, coupling, and pipeline system, an advantageous embodiment of the admixing system according to the present invention also has the components of supporting framework and ventilation.

If there are at least three watering or sprinkler units, at least one of the extinguishing agent additive lines may advantageously connect at least two of the watering or sprinkler units at a time to the extinguishing agent additive pump. In this way, the outlay connected with installation and operation of the extinguishing agent additive lines may be minimized.

Furthermore, if there are at least three watering or sprinkler units, watering or sprinkler units neighboring one another may each be assigned different extinguishing agent additive lines. In this way, among other things, an especially stable and reliable flow-through regulation is ensured.

For the same reason, independently thereof or in connection therewith, advantageously, no more than one extinguishing agent additive line may be assigned to each watering or sprinkler unit.

A further advantageous embodiment of the present invention is that, using at least one ring line, in the form of at least one extinguishing agent additive return line which connects the extinguishing agent additive container and the extinguishing agent additive lines to one another, for example, return of the extinguishing agent additive into the extinguishing agent additive container is ensured to prevent flocculation and/or decomposition of the extinguishing agent additive.

Since the extinguishing agent additive pump constantly sucks the extinguishing agent additive out of the extinguishing agent additive container even over longer distances in a way essential to the present invention, in contrast to other known extinguishing systems, such as extinguishing systems having Venturi blow tank admixers, an extinguishing agent additive container which is kept unpressurized may preferably be used in the present invention.

In addition, if an extinguishing agent additive pump of this type is used, the present invention functions depending on the flow-through quantity in the water line, but independently of the pressure in the water line. This offers the advantage that the extinguishing agent additive may be admixed to the extinguishing agent independently of the pressure in the extinguishing agent line; in contrast, Venturi or similar known admixing systems are strongly dependent both on starting and flow-through pressures and on counter pressures in the intake and delivery side water and accessory agent lines.

In the following, the construction of an advantageous embodiment of the extinguishing or watering system according to the present invention will be illustrated in detail for exemplary purposes.

In order to reliably avoid damage to the pump and achieve uniform dosing of the admixing while maintaining the required minimum admixing rate, the extinguishing agent additive lines may have at least one control and/or regulating unit. This control and/or regulating unit may be implemented as at least one electronic, hydraulic, and/or mechanical device which is adapted to the extinguishing or watering system.

For example, this control and/or regulating unit may be implemented as at least one pressure limiter, which, if a limiting or delivery pressure is exceeded, returns the extinguishing agent additive to the extinguishing agent additive container via the extinguishing agent additive return line.

In a simple variation, the control/regulating unit may be, for example, a spring-loaded pressure relief valve, which is set manually in accordance with the requirements of the speaker system. In this case, excess accessory agent may be returned to the accessory agent container as necessary.

It may also be advantageous, depending on the system type, to install further components. Thus, installing at least one check valve on at least one admixing point, i.e., in the region before, particularly shortly before the discharge of the particular extinguishing agent additive line into the particular extinguishing agent line, is typically useful in order to prevent unintended penetration of accessory agent into the extinguishing water line. A two-stage or multistage check system having a flushing device may also be provided if necessary. In any case, the embodiment is to be determined specifically for the system and user.

Furthermore, the present invention relates to a method, particularly for dosed mixing or adding of at least one extinguishing agent additive to at least one extinguishing agent, the extinguishing agent additive being supplied or fed to at least two watering or sprinkler units by at least one extinguishing agent additive pump, particularly by at least one admixer, via at least two extinguishing agent additive lines, the extinguishing agent additive being supplied or fed in the region before, particularly shortly before in relation to the flow direction, the particular watering or sprinkler unit, and the extinguishing agent additive pump mixing the extinguishing agent additive into the extinguishing agent or adding it to the extinguishing agent using overpressure.

This method is thus based on decentralized admixing of the extinguishing agent additive into the extinguishing agent line near the fire location, the accessory agent being conducted in its own pipelines.

In this case, the method according to the present invention reduces the time until the mixture is provided at the fire location and, in addition, the problems with the pipeline network and the premix. In addition, the method is suitable for all liquid extinguishing agent additives and for new extinguishing or watering systems and also for retrofitting of existing extinguishing or watering systems.

The method described is predominantly intended for extinguishing at least one conflagration and/or at least one fire, particularly at least one damaging fire, and/or for surface cooling using a fixed or partially mobile extinguishing system or watering system, particularly in accordance with DIN 14011-5:1980-05 (in this case, a conflagration is understood as a "damaging fire", which causes non-trivial damage and/or leaves its intended location, while in contrast an "useful fire" does not lead to any damage and/or does not leave its intended location).

Accordingly, the present invention finally relates to the use of at least one admixing system according to the type described above and/or at least one extinguishing or watering system according to the type described above and/or a method according to the type described above in at least one and/or at least one fixed or partially mobile extinguishing system or watering system, particularly in accordance with DIN 14011-5:1980-05.

BRIEF DESCRIPTION OF THE DRAWING

As already explained above, there are various possibilities for advantageously embodying and refining the teaching of the present invention. For this purpose, reference is made to the claims subordinate to claims 1 and 6, and, in addition, further embodiments, features, and advantages of the present invention will be explained in greater detail in the following on the basis of the exemplary embodiment illustrated by FIGS. 1 through 4.

Identical or similar embodiments, elements, or features are provided with identical reference numbers in FIGS. 1 through 4.

BEST WAY OF IMPLEMENTING THE PRESENT INVENTION

For simplified illustration, the principle of the features according to the present invention is shown in FIGS. 1 through 4 on a stationary or fixed sprinkler system 200.

However, the principle of the features according to the present invention is also applicable in other extinguishing systems, for example, in partially mobile fire extinguishing systems or in watering systems:

A partially mobile extinguishing facility is a system whose parts are not all installed fixed. A partially mobile extinguishing system is put into operation by supplying extinguishing agent 22 and if necessary by turning on suitable devices. Generally, semi-stationary fire extinguishing systems fall under this field of application.

A watering system is a system which delivers the extinguishing agent 22 for surface cooling.

Figure 1:
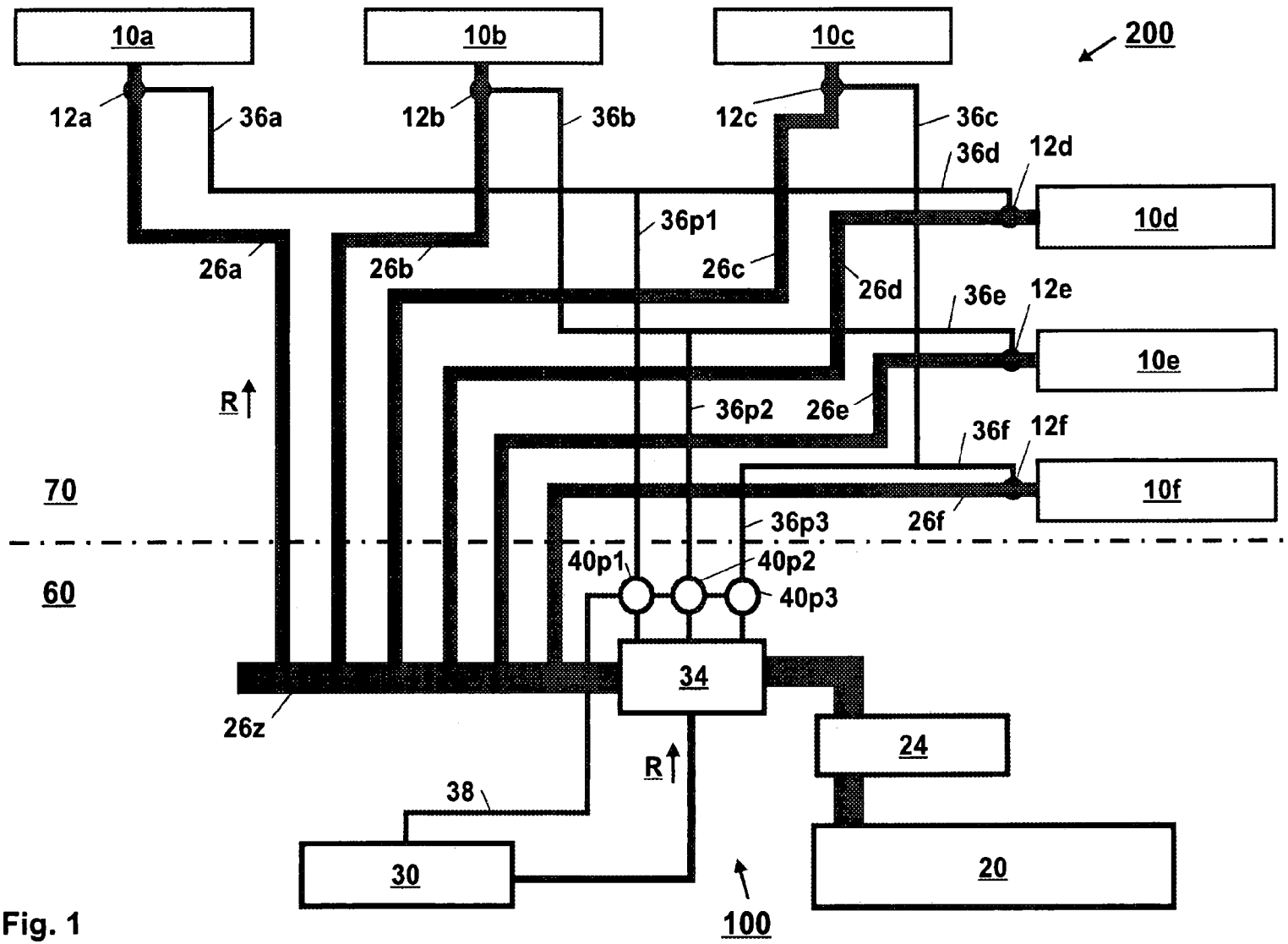
FIG. 1 shows a schematic illustration of an exemplary embodiment of an extinguishing or watering system according to the present invention, which has an admixing system according to the present invention and operates according to the method according to the present invention.
Figure 2:
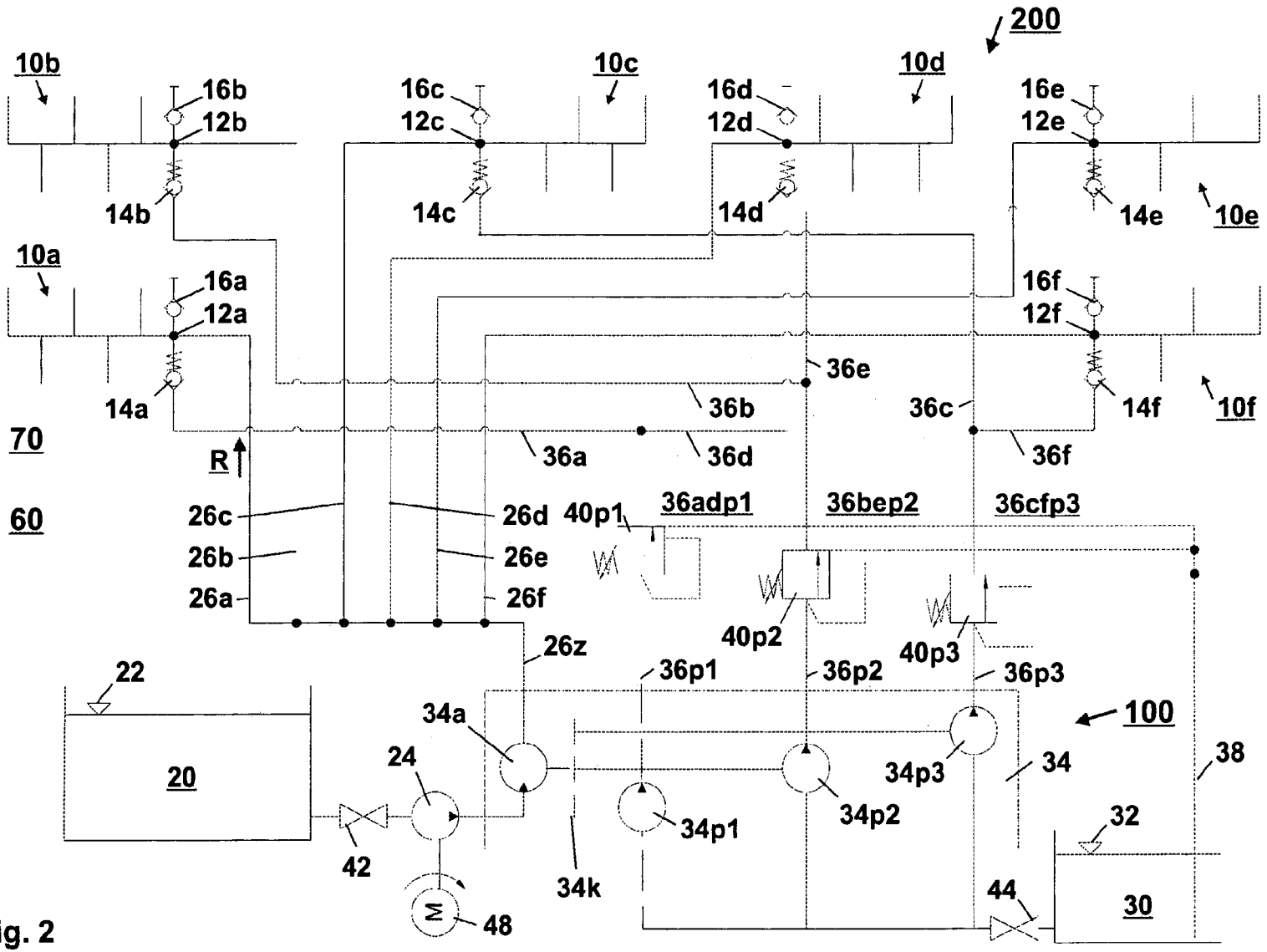
FIG. 2 shows a more detailed illustration of the extinguishing or watering system from FIG. 1 as a block diagram.

An exemplary embodiment of a six-group sprinkler system 200 is shown in FIGS. 1 and 2. This sprinkler system 200 has the following components, which are used for dosing and admixing extinguishing agent additive 32, at a suitable point—in an extinguishing control center 60 in FIGS. 1 and 2:

a central extinguishing agent additive container 30, specifically an accessory agent tank, any supply container able to be used as the accessory agent tank 30 because of the technical capabilities, as well as an admixer 34 for the extinguishing agent additive 32, which is connected to three extinguishing agent additive pipelines 36*p*1, 36*p*2, 36*p*3, to which three control/regulating units 40*p*1, 40*p*2, 40*p*3 are assigned, and which is connected via an accessory agent return line 38 to the accessory agent tank 30.

Furthermore, the following components are positioned in the control center 60 for supplying the sprinkler system 200 with extinguishing agent 22:

a central extinguishing agent tank or an extinguishing water supply 20 and an extinguishing agent pump 24 in the form of a sprinkler pump which is connected to a central extinguishing agent line 26*z*.

The central extinguishing agent line 26*z* is connected via six extinguishing agent lines 26*a*, 26*b*, 26*c*, 26*d*, 26*e*, 26*f* to six watering or sprinkler units 10, specifically six sprinkler groups 10*a*, 10*b*, 10*c*, 10*d*, 10*e*, 10*f*. The sprinkler groups 10*a*, 10*b*, 10*c*, 10*d*, 10*e*, 10*f* are assigned to an object 70, such as a building.

In the object 70, the extinguishing agent additive lines or accessory agent lines 36*p*1, 36*p*2, 36*p*3 branch in such a way that each accessory agent line 36*p*1 or 36*p*2 or 36*p*3, respectively, supplies two non-neighboring, particularly spatially separated (by distance from one another) and/or particularly structurally separated (by at least one partition wall 80, 82 in each case) sprinkler groups 10*a*, 10*d* or 10*b*, 10*e* or 10*c*, 10*f*, respectively, with extinguishing agent additive 32 via one extinguishing agent additive line 36*a*, 36*d* or 36*b*, 36*e* or 36*c*, 36*f*, respectively, in each case.

Figure 3:
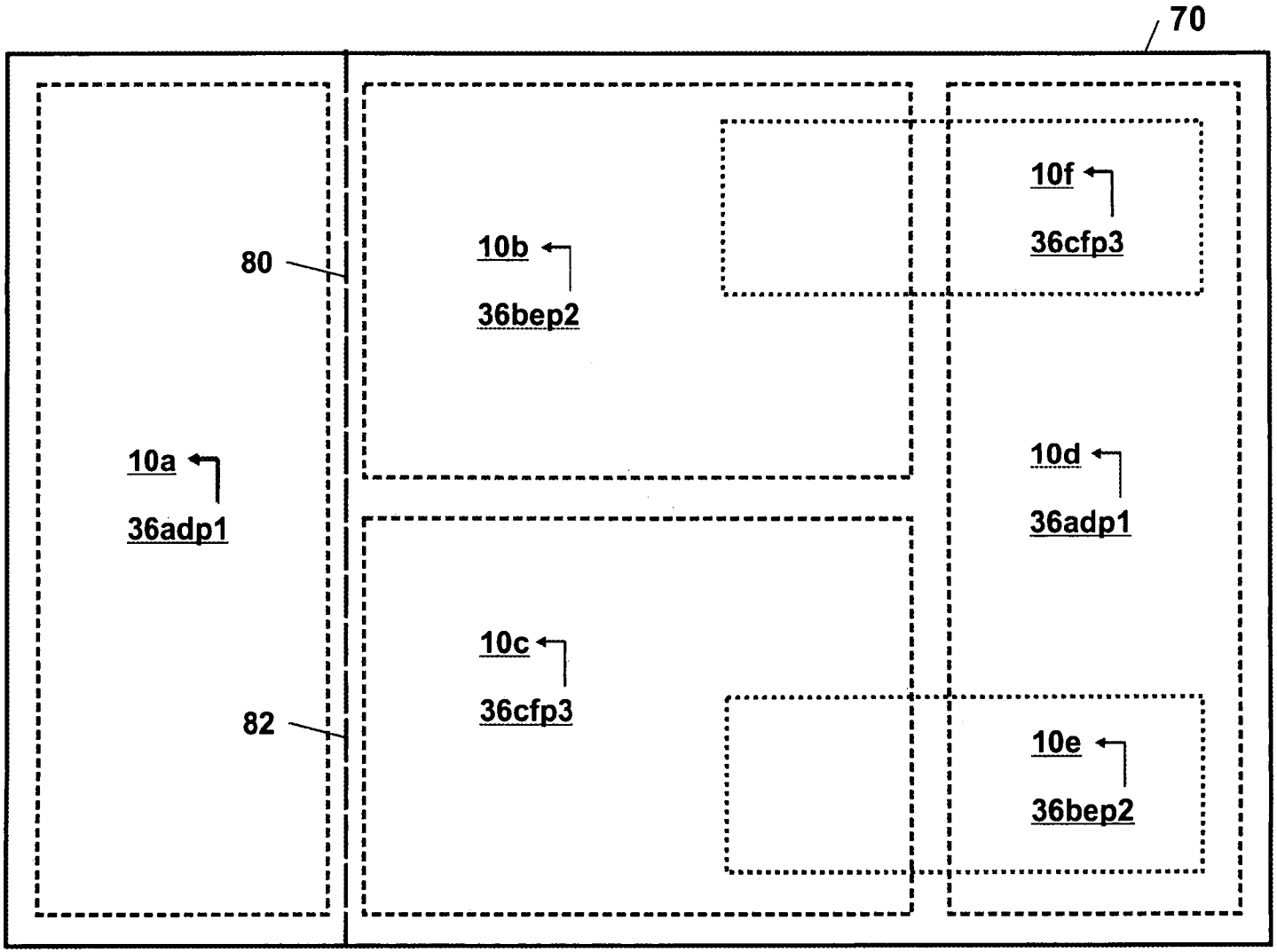
FIG. 3 shows a schematic illustration of an exemplary assignment of the extinguishing agent additive lines to the watering or sprinkler units of the extinguishing or watering system from FIGS. 1 and 2.

With the exception of the first sprinkler group 10*a*, which is structurally separated from the second sprinkler group 10*b* by a first partition wall 80 and from the third sprinkler group 10*c* by a second partition wall 82, in the exemplary case of FIG. 3 the sprinkler groups 10*a*, 10*d* and/or 10*b*, 10*e* and/or 10*c*, 10*f* are spatially separated from one another by distance. However, it is also possible in a way essential to the present invention to provide the spatial separation (produced through distance from one another) and the structural separation (provided by at least one partition wall) alternately to one another.

Accordingly,

- the extinguishing agent additive line 36*p*1 forms an accessory agent group 36*adp*1 with the extinguishing agent additive lines 36*a*, 36*d* assigned to the two sprinkler groups 10*a*, 10*d*,
- the extinguishing agent additive line 36*p*2 forms an accessory agent group 36*bep*2 with the extinguishing agent additive lines 36*b*, 36*e* assigned to the two sprinkler groups 10*b*, 10*e*, and
- the extinguishing agent additive line 36*p*3 forms an accessory agent group 36*cfp*3 with the extinguishing agent additive lines 36*c*, 36*f* assigned to the two sprinkler groups 10*c*, 10*f*.

The admixer or the dosing unit 34 obtains the accessory agent 32 from the stationary or mobile supply container 30 and feeds this accessory agent 32 into the extinguishing agent additive network 36 (=extinguishing agent additive lines 36*a*, 36*b*, 36*c*, 36*d*, 36*e*, 36*f*, 36*p*1, 36*p*2, 36*p*3) laid parallel to the extinguishing water network 26 (=extinguishing agent lines 26*a*, 26*b*, 26*c*, 26*d*, 26*e*, 26*f*, 26*z*).

The accessory agent groups 36*adp*1, 36*bep*2, 36*cfp*3 are controlled in such a way that the sprinkler groups 10 are admixed with the accessory agent 32 in an offset way; offset means that upon activation of the extinguishing system 200, exactly one accessory agent group 36*adp*1, 36*bep*2, 36*cfp*3 is assigned to each sprinkler group 10 until reaching the particular effective area of the extinguishing system 200. This is necessary so that the required minimum admixing rate is reached.

Specifically, if multiple sprinkler groups 10 were supplied via the same accessory agent group 36*adp*1, 36*bep*2, 36*cfp*3 in case of fire, the accessory agent would seek the more hydraulically favorable path, so that in one of the two or more sprinkler groups 10 affected, no or only restricted admixing would occur; the sprinkler groups in which the lower and/or lowest number of sprinkler heads had opened would be affected by the missing or restricted admixing.

The accessory agent lines 36 and/or the division of the accessory agent groups 36*adp*1, 36*bep*2, 36*cfp*3 are therefore fixed in regard to the object 70. An example of an object 70 fitting for FIG. 1 and FIG. 2 may be inferred from FIG. 3. In this case, the four sprinkler groups 10*a*, 10*b*, 10*c*, 10*d* are implemented as ceiling sprinklers and the two sprinkler groups 10*e*, 10*f* are implemented as shelf sprinklers.

According to the present invention, the accessory agent 32 is therefore admixed decentrally to the extinguishing agent 22 (cf. FIGS. 1 and 2). For this purpose, the admixing points 12*a* or 12*b* or 12*c* or 12*d* or 12*e* or 12*f*, respectively, i.e., the discharges of the accessory agent lines 36*a* or 36*b* or 36*c* or 36*d* or 36*e* or 36*f*, respectively, into the particular extinguishing agent line 26*a* or 26*b* or 26*c* or 26*d* or 26*e* or 26*f*, respectively, are led as close as possible to the individual sprinkler groups 10*a* or 10*b* or 10*c* or 10*d* or 10*e* or 10*f*, respectively, and therefore to the source of fire.

A structure of this type of the sprinkler system 200 allows, in a way essential to the present invention, the addition of the extinguishing agent additive 32 to be controlled centrally and simultaneously the extinguishing agent additive 32 to be admixed to the extinguishing agent 22 decentrally.

The admixer 34 (dosing pump or dosing unit) for the accessory agent 32 of the extinguishing system 200 is implemented in such a way that the admixer 34 allows a necessary admixing into the extinguishing agent lines 26. Pumps 34*p*1, 34*p*2, 34*p*3 (cf. FIG. 2), using which the accessory agent 32 may be introduced into the extinguishing agent line 26 under pressure, are suitable for this purpose. Piston pumps, for example, are suitable; pumps according to the Venturi principle or other "passive" admixing systems are less suitable.

It may be inferred from FIG. 2 that the dosing unit or the admixer 34 is based on a hydraulic drive 34*a*. The extinguishing water volume of the central extinguishing agent line 26*z* flows through the drive 34*a*. The mechanism inside the drive 34*a* exploits existing pressure differentials and converts these pressure differentials into a reciprocating and/or rotational movement.

Furthermore, it may be inferred from FIG. 2 that the admixer 34 conveys the accessory agent 32, using three extinguishing agent additive pumps 34*p*1 or 34*p*2 or 34*p*3, respectively, which are connected to the drive 34*a* via a mechanical coupling 34*k* for torque transmission, from the supply container 30 into the accessory agent lines 36*p*1 or 36*p*2 or 36*p*3, respectively, and from there indirectly into the extinguishing water volume flow of the sprinkler groups 10*a*, 10*d* or 10*b*, 10*e* or 10*c*, 10*f*, respectively.

The extinguishing agent additive pumps 34*p*1, 34*p*2, 34*p*3 of the admixer 34 overcome the pressure losses of the intake and admixing lines 36*p*1, 36*p*2, 36*p*3 in this context and produce the pressure increase necessary for admixing.

In addition, the admixer 34 is capable of feeding each accessory agent line and/or each accessory agent group 36*adp*1, 36*bep*2, 36*cfp*3 separately. In order to fulfill this function, for example, a multistage piston pump may be used as the admixer 34 or as the extinguishing agent additive, 34*p*1, 34*p*2, 34*p*3.

Generally, the functional capability described of a sprinkler system 200 is sufficient to meet the protective goals of fire protection and/or surface cooling for suitable firefighting. However, if an exact admixing rate is to be achieved for specific reasons of functional reliability of the extinguishing or watering system 200, further measures may be taken.

Exact admixing is achievable via the following two paths, for example:

(i) The individual accessory agent groups 36*adp*1, 36*bep*2, 36*cfp*3 do not receive fixed admixing rates, but rather flexible admixing rates, which are regulated in the particular accessory agent group 36*adp*1, 36*bep*2, 36*cfp*3 via the flow-through quantity (and therefore indirectly via the open sprinklers). This function is assumed in FIG. 1 by the measurement and regulating control elements 40*p*1, 40*p*2, 40*p*3.

It may be inferred from FIG. 2 that these regulating/control elements 40*p*1 or 40*p*2 or 40*p*3, respectively, may be adjustable pressure limiting valves having a dynamic range, which limit the input pressure of the particular accessory agent lines 36*p*1 or 36*p*2 or 36*p*3, respectively, through a precontrol. As a function of the design of the extinguishing or watering system 200, these regulating/control elements 40 may be positioned at at least one suitable point in the line network and do not have to be positioned near the admixer 34, as shown in FIGS. 1 and 2.

(ii) Each accessory agent group receives its own admixer 34 with a fixed admixing rate. Compared with FIG. 1, this means that an altered feed of the extinguishing water 22 is to be selected in the extinguishing control center 60, so that each admixer group 36*adp*1, 36*bep*2, 36*cfp*3 and/or two sprinkler groups 10 is assigned one admixer 34 (in this case: sprinkler groups 10*a*, 10*d* or 10*b*, 10*e* or 10*c*, 10*f*, respectively). A total of three dosing units are thus used. In contrast, the overpressure valves 40*p*1 or 40*p*2 or 40*p*3, respectively, may be dispensed with in this case.

It also may be necessary as a function of the system type to install further components. Thus, the installation of check valves 14*a* or 14*b* or 14*c* or 14*d* or 14*e* or 14*f*, respectively, having a spring dynamic range, in the accessory agent lines 26*a* or 26*b* or 26*c* or 26*d* or 26*e* or 26*f*, respectively, suggests itself, particularly at the admixing points 12*a* or 12*b* or 12*c* or 12*d* or 12*e* or 12*f*, respectively (cf. FIG. 2).

Furthermore, the check valves 14*a* or 14*b* or 14*c* or 14*d* or 14*e* or 14*f*, respectively, equipped with spring dynamic range are positioned diametrically opposite check valves 16*a* or 16*b* or 16*c* or 16*d* or 16*e* or 16*f*, respectively, without (spring) dynamic range.

In addition, a shutoff valve 42 is installed in the region of the outlet of the extinguishing water tank 20 and a shutoff valve 44 is installed in the region of the outlet of the accessory agent tank 30 (cf. FIG. 2)

as a further feed possibility in the stationary sprinkler system 200.

In the case of the exemplary embodiment of the present invention as a semi-stationary extinguishing system, the shutoff valves 42, 44 are advantageously used functionally for connecting extinguishing agent (additive) containers.

Finally, in regard to the system described above, it is to be considered that with the decentralized admixing using only one admixer 34 as shown in FIGS. 1 and 2, different admixing rates result in the individual sprinkler groups 10 if more than one sprinkler group 10*a*, 10*b*, 10*c*, 10*d*, 10*e*, 10*f* opens in case of fire.

If each piston of the admixing pump 34 has a fixed admixing rate of one percent, then a total admixing rate of two percent results if two sprinkler groups 10 (and/or accessory agent groups) open, and three percent for three sprinkler groups 10, etc. The admixing rate is not distributed uniformly to the sprinkler groups 10*a*, 10*b*, 10*c*, 10*d*, 10*e*, 10*f*, however, but rather proportionally to the sprinkler heads opened in each sprinkler groups 10*a*, 10*b*, 10*c*, 10*d*, 10*e*, 10*f*.

Figure 4:
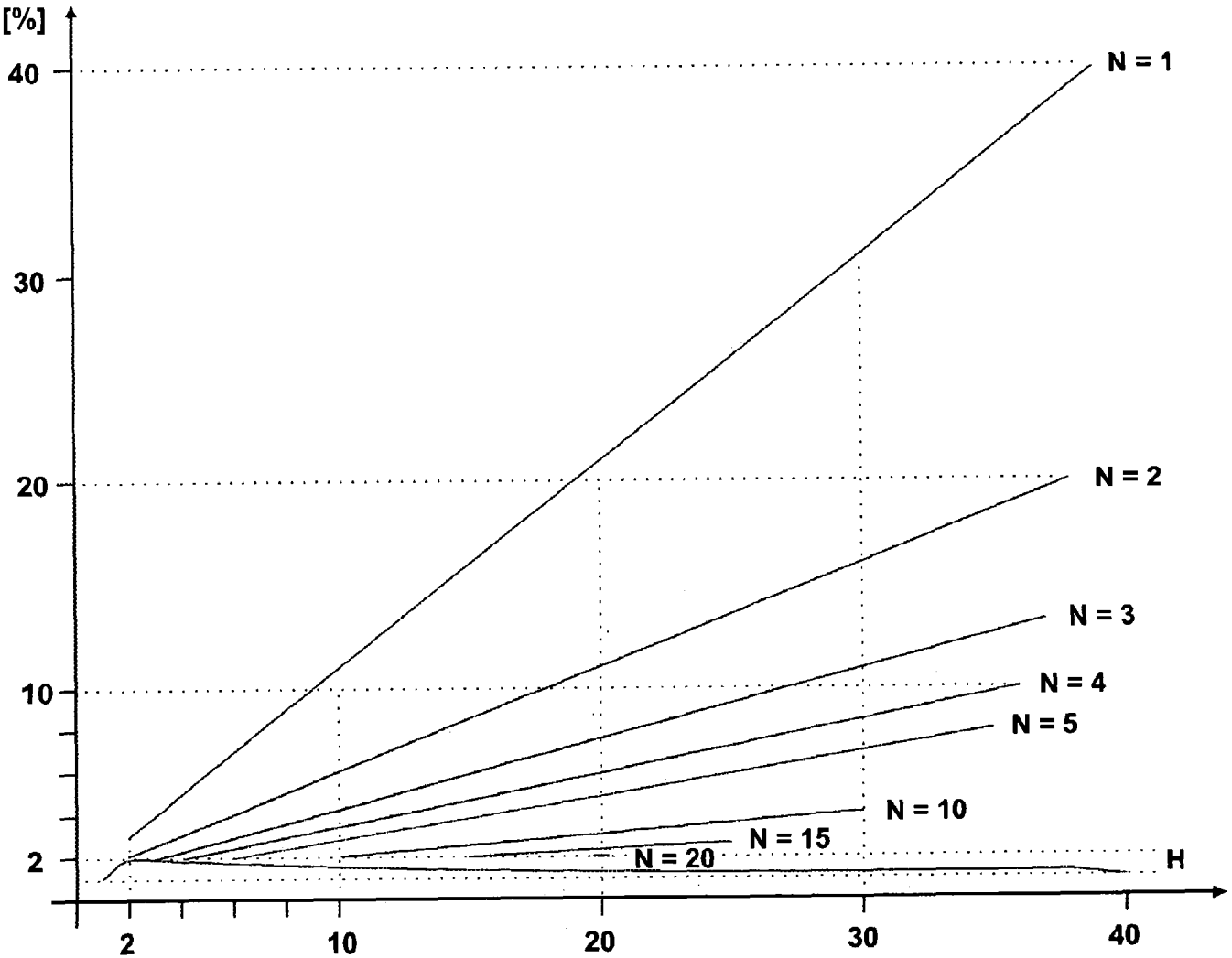
FIG. 4 shows a diagram of the distribution of the admixing rates of the extinguishing agent additive as a function of the number of open sprinklers of the watering or sprinkler units of the extinguishing or watering system from FIGS. 1 and 2.

An exemplary illustration of the resulting admixing rates for a sprinkler system 200 if multiple sprinkler groups 10*a*, 10*b*, 10*c*, 10*d*, 10*e*, 10*f* respond, having a total of 40 sprinkler heads, (imaginary maximum effective area of the sprinkler system) may be inferred from FIG. 4.

In FIG. 4, the number of all open sprinklers minus the open sprinklers of one secondary group, specifically the secondary group to be considered, is shown on the abscissa; the ordinate specifies the admixing rate of the secondary group observed. N indicates the number of sprinklers and H represents the main group. The main group is the sprinkler group in which the most sprinkler heads are open. In the course of a fire event, the main group and secondary group may vary and/or change through time-offset opening of sprinkler heads in different sprinkler groups.

As may be seen in FIG. 4, in any case overdosing will occur in the individual sprinkler groups 10*a*, 10*b*, 10*c*, 10*d*, 10*e*, 10*f*, so that the admixing rate will not fall below the minimum admixing rate (in this case: one percent).

LIST OF REFERENCE NUMBERS

100 admixing system

10 watering or sprinkler unit, particularly sprinkler group, of the extinguishing system 200, specifically

10*a* first watering or sprinkler unit, particularly first sprinkler group, such as the first ceiling sprinkler, of the extinguishing system 200

10*b* second watering or sprinkler unit, particularly second sprinkler group, such as the second ceiling sprinkler, of the extinguishing system 200

10*c* third watering or sprinkler unit, particularly third sprinkler group, such as the third ceiling sprinkler, of the extinguishing system 200

10*d* fourth watering or sprinkler unit, particularly fourth sprinkler group, such as the fourth ceiling sprinkler, of the extinguishing system 200

10*e* fifth watering or sprinkler unit, particularly fifth sprinkler group, such as the first shelf sprinkler, of the extinguishing system 200

10*f* sixth watering or sprinkler unit, particularly sixth sprinkler group, such as the second shelf sprinkler, of the extinguishing system 200

12*a* admixing point assigned to the first watering or sprinkler unit 10*a*

12*b* admixing point assigned to the second watering or sprinkler unit 10*b*

12*c* admixing point assigned to the third watering or sprinkler unit 10*c*

12*d* admixing point assigned to the fourth watering or sprinkler unit 10*d*

12*e* admixing point assigned to the fifth watering or sprinkler unit 10*e*

12*f* admixing point assigned to the sixth watering or sprinkler unit 10*f*

14*a* check valve having dynamic range and/or having a spring, assigned to the first watering or sprinkler unit 10*a*, particularly positioned in the extinguishing agent additive line 36*a*

14*b* check valve having dynamic range and/or having a spring, assigned to the second watering or sprinkler unit 10*b*, particularly positioned in the extinguishing agent additive line 36*b*

14*c* check valve having dynamic range and/or having a spring, assigned to the third watering or sprinkler unit 10*c*, particularly positioned in the extinguishing agent additive line 36*c*

14*d* check valve having dynamic range and/or having a spring, assigned to the fourth watering or sprinkler unit 10*d*, particularly positioned in the extinguishing agent additive line 36*d*

14*e* check valve having dynamic range and/or having a spring, assigned to the fifth watering or sprinkler unit 10*e*, particularly positioned in the extinguishing agent additive line 36*e*

14*f* check valve having dynamic range and/or having a spring, assigned to the sixth watering or sprinkler unit 10*f*, particularly positioned in the extinguishing agent additive line 36*f*

16*a* check valve without dynamic range and/or without a spring, assigned to the first watering or sprinkler unit 10*a*

16*b* check valve without dynamic range and/or without a spring, assigned to the second watering or sprinkler unit 10*b*

16*c* check valve without dynamic range and/or without a spring, assigned to the third watering or sprinkler unit 10*c*

16*d* check valve without dynamic range and/or without a spring, assigned to the fourth watering or sprinkler unit 10*d*

16*e* check valve without dynamic range and/or without a spring, assigned to the fifth watering or sprinkler unit 10*e*

16*f* check valve without dynamic range and/or without a spring, assigned to the sixth watering or sprinkler unit 10*f*

20 extinguishing agent container, particularly extinguishing agent tank or extinguishing water supply

22 extinguishing agent, particularly extinguishing water

24 extinguishing agent pump, particularly hydraulic pump and/or sprinkler pump

26 extinguishing agent line or extinguishing agent network, specifically

26*a* extinguishing agent line assigned to the first watering or sprinkler unit 10*a*

26*b* extinguishing agent line assigned to the second watering or sprinkler unit 10*b*

26*c* extinguishing agent line assigned to the third watering or sprinkler unit 10*c*

26*d* extinguishing agent line assigned to the fourth watering or sprinkler unit 10*d*

26*e* extinguishing agent line assigned to the fifth watering or sprinkler unit 10*e*

26*f* extinguishing agent line assigned to the sixth watering or sprinkler unit 10*f*

26*z* central extinguishing agent line

30 extinguishing agent additive container, particularly accessory agent tank

32 extinguishing agent additive

34 dosing unit or admixer

34*a* drive, particularly hydraulic motor having a constant displacement volume, of the dosing unit or the admixer 34

34*k* coupling, particularly mechanical coupling, between drive 34*a* and extinguishing agent additive pumps 34*p*1, 34*p*2, 34*p*3

34*p*1 first extinguishing agent additive pump of the dosing unit or the admixer 34

34*p*2 second extinguishing agent additive pump of the dosing unit or the admixer 34

34*p*3 third extinguishing agent additive pump of the dosing unit or the admixer 34

36 extinguishing agent additive line or extinguishing agent additive network, specifically

36*a* extinguishing agent additive line assigned to the first watering or sprinkler unit 10*a*

36*b* extinguishing agent additive line assigned to the second watering or sprinkler unit 10*b*

36*c* extinguishing agent additive line assigned to the third watering or sprinkler unit 10*c*

36*d* extinguishing agent additive line assigned to the fourth watering or sprinkler unit 10*d*

36*e* extinguishing agent additive line assigned to the fifth watering or sprinkler unit 10*e*

36*f* extinguishing agent additive line assigned to the sixth watering or sprinkler unit 10*f*

36*p*1 extinguishing agent additive line assigned to the first extinguishing agent additive pump 34*p*1

36*p*2 extinguishing agent additive line assigned to the second extinguishing agent additive pump 34*p*2

36*p*3 extinguishing agent additive line assigned to the third extinguishing agent additive pump 34*p*3

36*adp*1 accessory agent group assigned to the first extinguishing agent additive pump 34*p*1

36*bep*2 accessory agent group assigned to the second extinguishing agent additive pump 34*p*2

36*cfp*3 accessory agent group assigned to the third extinguishing agent additive pump 34*p*3

38 extinguishing agent additive return line, particularly accessory agent return line

40*p*1 control and/or regulating unit assigned to the first extinguishing agent additive pump 34*p*1, particularly positioned in the extinguishing agent additive line 36*p*1

40*p*2 control and/or regulating unit assigned to the second extinguishing agent additive pump 34*p*2, particularly positioned in the extinguishing agent additive line 36*p*2

40*p*3 control and/or regulating unit assigned to the third extinguishing agent additive pump 34*p*3, particularly positioned in the extinguishing agent additive line 36*p*3

42 shutoff mechanism or shutoff valve of the extinguishing agent container 20

44 shutoff mechanism or shutoff valve of the extinguishing agent additive container 30

48 drive, particularly electric motor or combustion engine, of the extinguishing agent pump 24

60 extinguishing control center

70 object

80 first partition wall, particularly between first watering or sprinkler unit 10*a* and second watering or sprinkler unit 10*b*

82 second partition wall, particularly between first watering or sprinkler unit 10*a* and third watering or sprinkler unit 10*c*

200 extinguishing or watering system, particularly sprinkler system or fire extinguishing system H main group N number of open sprinklers of the secondary group observed R flow direction

The invention claimed is:

1. An admixing system (100) for admixing at least one extinguishing agent additive (32) to at least one extinguishing agent (22), having extinguishing agent additive pumps (34*p*1, 34*p*2, 34*p*3) connected by at least three watering or sprinkler units (10}, one of the pumps being a component of or in the form of at least one dosing unit or at least one admixer (34), a. which pump mixes the extinguishing agent additive (32) into at least two extinguishing agent lines (26) using overpressure and b. which is connected to at least two of the watering or sprinkler units (10) respectively via at least one extinguishing agent additive line (36) and the particular extinguishing agent line (26*a*, 26*b*, 26*c*, 26*d*, 26*e*, 26*f*) is brought together and unified with the particular extinguishing agent additive line (36*a*, 36*b*, 36*c*, 36*d*, 36*e*, 36*f*) in the region of the particular watering or sprinkler unit (10), wherein neighboring watering or sprinkler units (10) are each assigned different extinguishing agent additive lines (36*p*1, 36*p*2, 36*p*3).

2. The admixing system according to claim 1, wherein if there are at least three watering or sprinkler units (10)

not more than one extinguishing agent additive line (36) is assigned to each watering or sprinkler unit (10).

3. The admixing system according to claim 1, wherein the extinguishing agent additive line (36*a*, 36*b*, 36*c*, 36*d*, 36*e*, 36*f*) has at least one check valve (14*a*, 14*b*, 14*c*, 14*d*, 14*e*, 14*f*) which may be positioned in the region of the discharge of the particular extinguishing agent additive line (36*a*, 36*b*,

36*c*, 36*d*, 36*e*, 36*f*) into the particular extinguishing agent line (26*a*, 26*b*, 26*c*, 26*d*, 26*e*, 26*f*).

4. The admixing system according to claim 3, wherein the check valve is multi-stage with a flush device.

5. The admixing system according to claim 3, wherein the check valve is positioned shortly before, in relation to the flow direction (R), the discharge of the particular extinguishing agent additive line into the particular extinguishing agent line.

6. The admixing system according to claim 1, wherein the extinguishing agent additive pumps (34*p*1, 34*p*2, 34*p*3) at least one of feed the extinguishing agent additive (32) into each of the extinguishing agent additive lines (36) separately, and are designed for at least one of control and regulation of the quantity of the extinguishing agent additive (32) to be fed into the particular extinguishing agent additive line (36).

7. The admixing system according to claim 1, wherein at least one extinguishing agent additive pump (34*p*1, 34*p*2, 34*p*3) is assigned to each extinguishing agent additive line (36), and the at least one extinguishing agent additive pump (34*p*1, 34*p*2, 34*p*3) pumps a fixed quantity of extinguishing agent additive (32) into the particular extinguishing agent additive line (36).

8. An extinguishing or watering system (200), having at least one admixing system (100) according to claim 1, at least one extinguishing agent container (20) for storing the extinguishing agent (22), at least one extinguishing agent pump (24), which is connected to each of the watering or sprinkler units (10) respectively via at least one extinguishing agent line (26), and at least one extinguishing agent additive container (30) for storing the extinguishing agent additive (32).

9. The extinguishing or watering system according to claim 8, wherein the extinguishing agent additive container (30) is connected to the extinguishing agent additive lines (36) via at least one extinguishing agent additive return line (38) and the extinguishing agent additive (32) may be returned into the extinguishing agent additive container (30) via the extinguishing agent additive return line (38).

10. The extinguishing or watering system according to claim 9, wherein the extinguishing agent additive lines (36) have at least one unit (40*p*1, 40*p*2, 40*p*3) which returns the extinguishing agent additive (32) into the extinguishing agent additive container (30) via the extinguishing agent additive return line (38) if a limiting or delivery pressure is exceeded.

11. The extinguishing or watering system according to claim 10, wherein the unit (40*p*1, 40*p*2, 40*p*3) which returns the extinguishing agent additive is a pressure limiter.

12. The extinguishing or watering system according to claim 10, wherein the unit (40*p*1, 40*p*2, 40*p*3) which returns the extinguishing agent additive is at least one of electronic hydraulic and mechanical.

13. The admixing system according to claim 1, wherein the particular extinguishing agent line (26*a*, 26*b*, 26*c*, 26*d*, 26*e*, 26*f*) is combined with the particular extinguishing agent additive line (36*a*, 36*b*, 36*c*, 36*d*, 36*e*, 36*f*) shortly before, in regard to the flow direction (R), the particular watering or sprinkler unit (10).

14. A method particularly for dosed mixing or adding of at least one extinguishing agent additive (32) to at least one extinguishing agent (22), wherein the extinguishing agent additive (32) is supplied or fed to neighboring watering or sprinkler units (10) by at least one extinguishing agent additive pump (34*p*1, 34*p*2, 34*p*3) via in each case a different extinguishing agent additive line (36*p*1, 36*p*2, 36*p*3), the supply or feeding of the extinguishing agent additive (32) is performed in the region shortly before, in relation to the flow direction (R), the particular watering or sprinkler unit (10}, and the extinguishing agent additive pump (34*p*1, 34*p*2, 34*p*3) mixes the extinguishing agent additive (32) into the extinguishing agent (22) or adds the additive to the extinguishing agent (22) using overpressure.

15. The method according to claim 14, wherein the pump is an admixer.

* * * * *